US006641306B1

(12) United States Patent
Knoerzer et al.

(10) Patent No.: US 6,641,306 B1
(45) Date of Patent: Nov. 4, 2003

(54) PACKAGE WITH PROTRUSION POUCH AND METHOD FOR MAKING THE SAME

(75) Inventors: Anthony Robert Knoerzer, Plano, TX (US); Garrett William Kohl, Allen, TX (US); Steven Kenneth Tucker, Hurst, TX (US)

(73) Assignee: Recot, Inc., Pleasanton, CA (US)

( * ) Notice: Subject to any disclaimer, the term of this patent is extended or adjusted under 35 U.S.C. 154(b) by 0 days.

(21) Appl. No.: 10/156,421

(22) Filed: May 28, 2002

(51) Int. Cl.[7] ..... B65B 61/20; B65D 30/22

(52) U.S. Cl. ..... 383/38; 53/415; 53/451; 53/474; 206/495.5

(58) Field of Search ..... 53/415, 451, 474, 53/202, 238; 206/459.5, 831; 383/38

(56) References Cited

U.S. PATENT DOCUMENTS

| | | | | |
|---|---|---|---|---|
| 2,153,846 A | | 4/1939 | Russell et al. | |
| 2,260,064 A | * | 10/1941 | Stokes | 53/415 |
| 2,771,724 A | * | 11/1956 | Hosier | 53/474 |
| 2,815,620 A | * | 12/1957 | Prodigo | 53/415 |
| 3,469,768 A | * | 9/1969 | Repko | 383/38 |
| 3,581,457 A | * | 6/1971 | Gerlach et al. | 53/202 |
| 3,795,081 A | * | 3/1974 | Brown et al. | 53/451 |
| 3,861,522 A | * | 1/1975 | Llewellyn et al. | 53/451 |
| 3,992,854 A | * | 11/1976 | Howell et al. | 53/474 |
| 3,998,135 A | * | 12/1976 | Sargent | 53/415 |
| 4,274,244 A | * | 6/1981 | Gilbert | 53/451 |
| 4,526,566 A | | 7/1985 | Briand | |
| 4,563,231 A | | 1/1986 | Porrmann et al. | |
| 4,925,438 A | | 5/1990 | Wagner | |
| 5,030,190 A | | 7/1991 | Woods et al. | |
| 5,540,333 A | * | 7/1996 | Gonzalez et al. | 383/38 |
| 5,590,783 A | | 1/1997 | Capy et al. | |
| 5,971,200 A | * | 10/1999 | Reynolds | 383/38 |
| 6,237,533 B1 | * | 5/2001 | Rodriguez | 383/38 |

FOREIGN PATENT DOCUMENTS

WO PCT/FR93/00303 10/1993

* cited by examiner

*Primary Examiner*—John Sipos
(74) *Attorney, Agent, or Firm*—Colin P. Cahoon; Carstens, Yee & Cahoon, L.L.P.

(57) ABSTRACT

A flexible package and method for making the same provides for a package that has a pouch formed adjacent to a portion of a package. Thereby, the package, such as a snack food package, can be filled with one product in the main compartment of the package and can be filled with a separate product in the pouch. To realize this, the package is formed with an extra length of film extended adjacent to the main portion of the tube of the package. First and second longitudinal seals are provided to form the pouch over a portion of the tube of the package. The package can then be filled with a first product in the main portion of the package and a second product in the separate and distinct pouch. As the pouch is filled, the material of the pouch protrudes away from the surface of the main portion of the package.

16 Claims, 2 Drawing Sheets

PACKAGE WITH PROTRUSION POUCH AND METHOD FOR MAKING THE SAME

BACKGROUND OF THE INVENTION

1. Technical Field

The present invention relates to flexible packages, and the method for making same. More particularly, the present invention relates to flexible packages, and the method for making the same that contain a separate pouch. The invention allows for use of flexible packages with a pouch that can be filled with materials that will be kept separate from a main portion of the package.

2. Description of Related Art

Vertical form, fill, and seal packaging machines are commonly used in the snack food industry for forming, filling, and sealing bags of chips and other like products. Such packaging machines take a packaging film from a sheet roll and forms the film into a vertical tube around a product delivery cylinder. The vertical tube is vertically sealed along its length to form a back seal. The machine applies a pair of heat-sealing jaws or facings against the tube to form a transverse seal. This transverse seal acts as the top seal on the bag below and the bottom seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thus sealing it within the film tube and forming a package of product. The package below said transverse seal is separated from the rest of the film tube by cutting across the sealed area.

The packaging film used in such process is typically a composite polymer material produced by a film converter. For example, one prior art composite film used for packaging potato chips and like products is illustrated in FIG. 1*a*, which is a schematic of a cross-section of the film illustrating each individual substantive layer. FIG. 1*a* shows an inside, or product side, layer 16 which typically comprises metalized oriented polypropylene ("OPP") or metalized polyethylene terephtalate ("PET"). This is followed by a laminate layer 14, typically a polyethylene extrusion, and an ink or graphics layer 12. The ink layer 12 is typically used for the presentation of graphics that can be viewed through a transparent outside layer 10, which layer 10 is typically OPP or PET.

The prior art film composition shown in FIG. 1*a* is ideally suited for use on vertical form and fill machines for the packaging of food products. The metalized inside layer 16, which is usually metalized with a thin layer of aluminum, provides excellent barrier properties. The use of OPP or PET for the outside layer 10 and the inside layer 16 further makes it possible to heat seal any surface of the film to any other surface in forming either the transverse seals or back seal of a package.

Typical back seals formed using the film composition shown in FIG. 1*a* are illustrated in FIGS. 2 and 3. FIG. 2 is a schematic of a "lap seal" embodiment of a back seal being formed on a tube of film. FIG. 3 illustrates a "fin seal" embodiment of a back seal being formed on a tube of film.

With reference to FIG. 2, a portion of the inside metalized layer 26 is mated with a portion of the outside layer 20 in the area indicated by the arrows to form a lap seal. The seal in this area is accomplished by applying heat and pressure to the film in such area. The lap seal design shown in FIG. 2 insures that the product to be placed inside the formed package will be protected from the ink layer by the metalized inside layer 26.

The fin seal variation shown in FIG. 3 also provides that the product to be placed in the formed package will be protected from the ink layer by the metalized inside layer 36. Again, the outside layer 30 does not contact any product. In the embodiment shown in FIG. 3, however, the inside layer 36 is folded over and then sealed on itself in the area indicated by the arrows. Again, this seal is accomplished by the application of heat and pressure to the film in the area illustrated.

As noted, a benefit of both the prior art fin seal and lap seal design is the containment of the product in the package by a barrier layer (the metalized inside layer) that keeps ink and solvent levels in the package to a minimum. Ink and solvent levels in fatty food packages are frequently regulated to insure product safety. It may be desirable, however, to provide a graphics capability inside a package. This would allow for promotional information or coupons to be maintained inside the package and only accessible after the consumer has opened the package. For example, a promotional prize campaign could be offered with the prize announcements being maintained inside the package. Likewise, coupons offering product rebate rewards, promotional prize points, or discounts on products could be maintained within the sealed package.

One prior art method used to provide a graphics capability inside the package involves the use of a paper insert dropped with the product into the package during filling. When the consumer opens the package, the paper insert can be removed for viewing and use. This method has several drawbacks, however. The reliability of placing a single paper insert in each bag (by dropping the paper with a weighed amount of product) is a major consideration, particularly in small packages. A capacity issue is raised by the need to rent inserters to be used during the filling process. Foreign matter detectors are also frequently set off by the detection of the paper insert within the bag. The insertion of a piece of paper can raise the solvent level in the package beyond acceptable levels. All of the above greatly adds to the expense of each single package.

Another approach to providing graphics within the bag would involve the application of the graphics directly to the inside metalized layer 16 shown in FIG. 1*a*. The application of such graphics can be accomplished using an inkjet printer. However, this method likewise raises a capacity issue, since present technology converters produce packaging film at a speed of 1500 to 2000 feet per minute, while the capacity of present inkjet printer heads is approximately 300 feet per minute. Additional modification to converters must be made in order to keep the inkjet printing in register with the graphics formed by the ink layer 12. All of the above considerations again add to the cost of the package. In addition, the United States Food & Drug Administration does not presently allow for the use of an ink-carrying layer that comes into contact with a fatty food.

Another prior art approach to this issue is illustrated in FIG. 1*b*, which is again a schematic cross-section of a packaging film. As with the embodiment shown in FIG. 1*a*, the embodiment shown in FIG. 1*b* comprises an outside OPP layer 10 followed by an ink layer 12, a laminate layer 14, and a metalized OPP or PET layer 16. However, an additional laminate layer 14' is applied to the metalized layer 16 so that an additional ink layer 12' and OPP or PET layer 10' can be used as the new inside layer 10'. The use of the ink layers 12, 12' as the second to last layer on both the outside and inside of the package allows for a full graphics capability on both the outside and the inside of the film. The additional film, however, adds approximately sixty percent (60%) to the cost of the material when compared with the embodiment shown in FIG. 1*a*. Overall capacity is also cut in half, since the film must be run through a typical converter twice. Further, since the material is 60% thicker, it cannot be run on a vertical form and fill machine at speeds as high as that used to make packages out of the embodiment shown in FIG. 1*a*. This is because longer dwell times must be used to form all the seals involved. As with the inkjet printer solution, the embodiment shown in FIG. 2*a* also requires additional efforts to keep the inside graphics and outside graphics in registration. Importantly, the embodiment shown in FIG. 1*b* again places ink inside a functional barrier layer, the metalized layer 16, which is not presently permitted for direct contact with many foods by the United States Food & Drug Administration.

In addition to ink and solvent concerns with package construction, packages, particularly with snack foods, benefit from marketing. With current packaging, inserts or other graphics, such as coupons, prizes, and game pieces, are separately packaged and deposited into snack food packages or are temporally adhered to the exterior of the packages. With the former, inserts are hidden from consumers hindering the effectiveness of the promotion. With the latter, graphic materials adhered to package exteriors can be dislodged and lost. Consequently, a need exists for a package construction and method that allows for a package to self-contain inserts, graphic materials, and other products separated from the main compartment of the package. Furthermore, flexible package constructions would benefit from having a separate compartment for placement of materials with graphics. This would avoid or, at least minimize, ink and solvent contact with food in addition to marketing benefits. Also, it is desired for this package to hold a variety of inserts while maintaining a consistent external appearance independent of the size of those inserts.

SUMMARY OF THE INVENTION

The proposed invention involves producing a package made from flexible film having a film body formed as a discrete package. A pouch for containing materials separate from a main portion of the package is formed on and along a portion of the package. To achieve this, the pouch is formed from a continuous segment of film laid against the main portion of the package. Thereby, the package can be filled with a first product such as snack chips while the pouch is filled with a printed article or other food product. Advantageously, the first product is kept separate from the second product placed in the pouch. This avoids any product-to-product contamination. The pouch has a distinctive bulge or bubble whereby the material that forms the pouch protrudes away from the main portion of the package.

One method for forming a package with a pouch comprises forming a sheet of film into a tube with an overlapped segment of film extending out and over the tube to form the pouch. Thereafter, at least two seals are formed longitudinally along the overlapped segment of film forming the pouch. The amount of film forming the pouch is greater than the distance between the two seals. Thereby, a bulge or bubble of film protrudes away from the main portion of the package. Sealing both terminal ends of the tube and the pouch finishes the package.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1A:
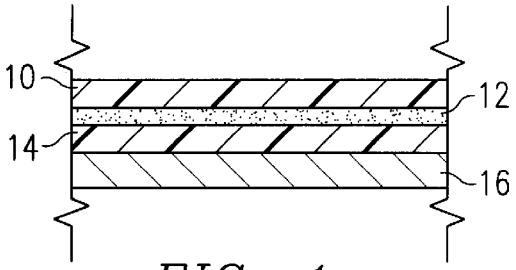
FIG. 1a (PRIOR ART)
FIGS. 1*a* and 1*b* are schematic cross-section views of prior art packaging films.
Figure 1B:
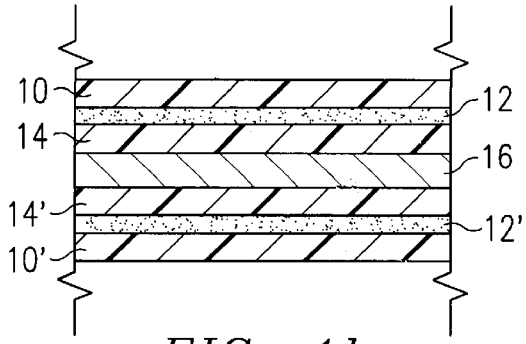
FIG. 1b (PRIOR ART)
Figure 2:
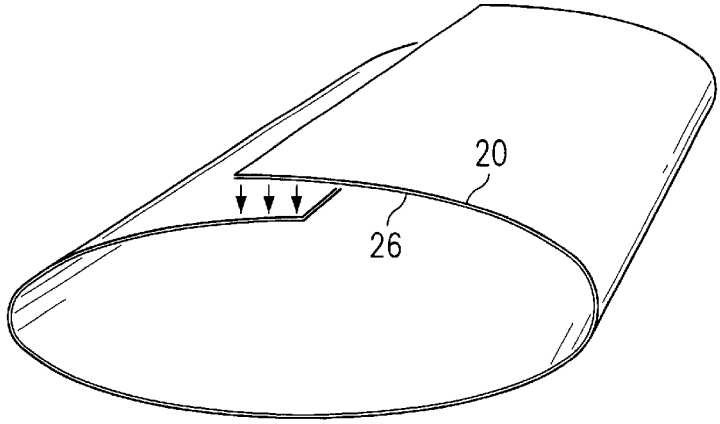
FIG. 2 (PRIOR ART)
FIG. 2 is a schematic cross-section view of a tube of packaging film illustrating the formation of a prior art lap seal.
Figure 3:
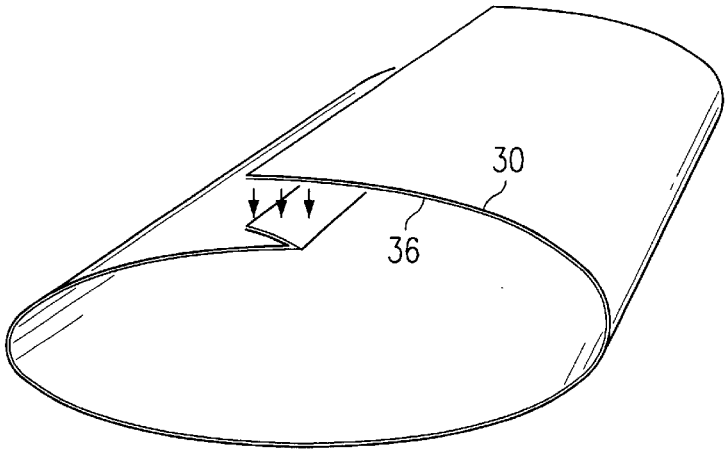
FIG. 3 (PRIOR ART)
FIG. 3 is a schematic cross-section of a tube of packaging film illustrating the formation of a prior art fin seal.
Figure 4:
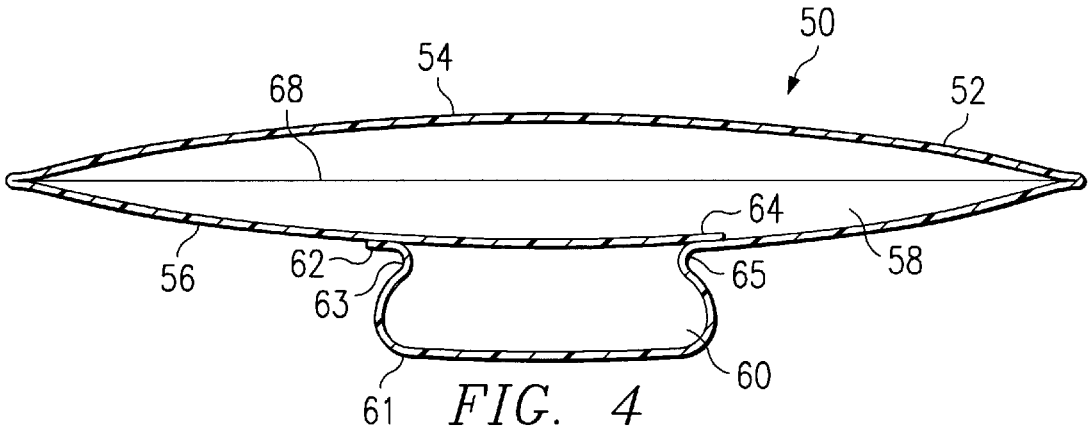
FIG. 4 is a cross-sectional view of a package having a protrusion pouch made in accordance with an embodiment of the invention.

FIG. 4 shows a cross sectional view of a flexible package 50 for containing snack food products. The composition of the package material can be the same as used for prior art packaging as described in relation to FIG. 1*a* or any other prior art film composition used for the product application in the instant invention.

A film 52 used in the present invention is fed into a vertical or horizontal form, fill, and seal packaging machine capable of manufacturing a package in accordance with the invention. Thereby, package 50 is formed having a front 54 and a back 56. Since film 52 is a flat film, film 52 is fed into the packaging machine generally to form a cylinder. The leading end of the film is sealed to a trailing end of the same film to form a first back seal 62 rendering the cylinder independent. A second back seal 64 is formed parallel to first back seal 62 with a segment of film 52. In one embodiment, back seals 62, 64 are simultaneously formed parallel to each other forming pouch 60, which is separate from a main portion 58 of package 50. Pouch 60 is formed such that it is separate from inside portion 58 and can retain a separate product or article. Particularly, pouch 60 comprises a distinct loop of film 52 that when extends out and away from back 56. Once package 50 is complete, a transverse end seal 68 can be formed at both ends of package 50.

Back seals 62, 64 are unlike prior art seals in that it is not merely a thin seal of overlapped film. Here, film 52 is wrapped to form pouch 60. More particularly, pouch 60 is formed, for example, by allowing terminal ends from a sheet of film 52 to extend over and above from the formed cylinder, which surrounds inside portion 58. The portion of film 52 that is laid above back 56 to form pouch 60 is external portion 61. Back seals 62, 64 can then be optionally formed longitudinally down the length of the tube. Back seals 62, 64 can extend down from one terminal end of package 50 to the other end to form pouch 60. However, other embodiments are possible such as adding additional transverse seals across the overlapped portion of film 52 to form an abbreviated pouch or multiple pouches. In an alternative embodiment, film 52 can be wrapped to extend inward to form a pouch (not shown) that would protrude into the interior of package 50.

Figure 5:
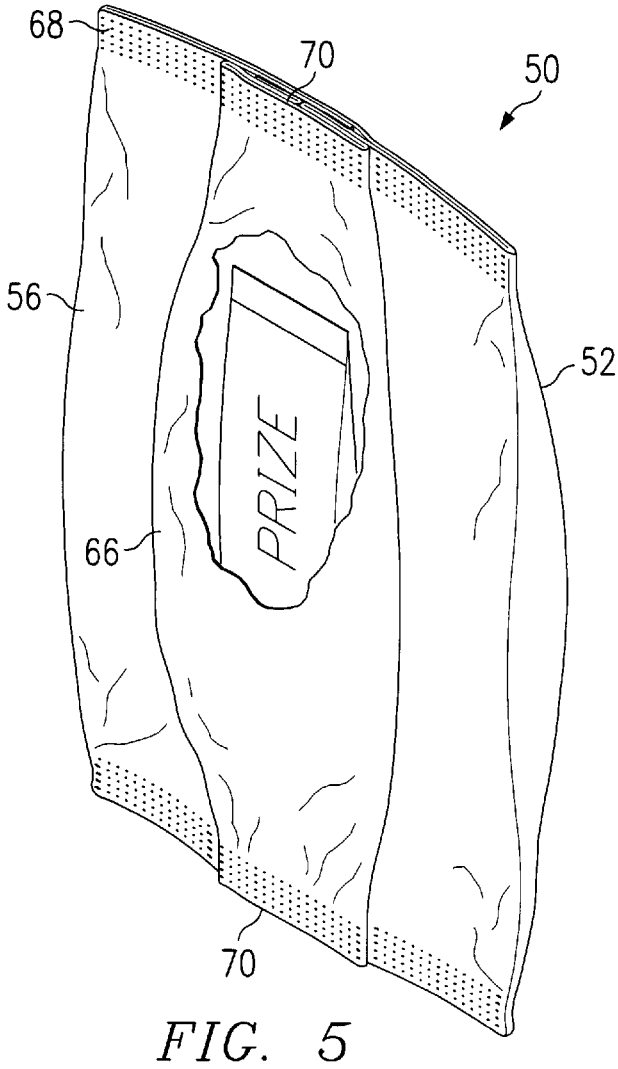
FIG. 5 is a top perspective view of the package in FIG. 4 showing an article contained within the protrusion pouch.

Generally, terminal segments 70 of external portion 61 are sealed along with transverse seals 68 of package 50 as shown in FIG. 5, which is a top perspective view of package 50. This forms the top and bottom seals of discreet package 50 and pouch 60 wherein product may be stored. Terminal segments 70 that coincide with traverse seals 68 extend from the position where portion 61 extends forth from first back seal 62 and ends at second back seal 64. Thereby, portion 61 is positioned above back 56. In another embodiment, one or more additional back seals (not shown) can be formed between first and second back seals 62, 64. Thereby, pouch 60 can be separated into two or more distinct pouches. This would be advantageous if additional items need to be packaged separate from each other and from products in main portion 58.

As package 50 is comprised of a flexible material, portion 61 will generally extend upward, i.e., bubbled, from back 56 to accommodate a material held within pouch 60. Shown in FIG. 5 is a material 66 within pouch 60, which can comprise items such, for example, as prizes, contest materials, food product, or pamphlets. By providing folds 63, 65, a generally uniform package 50 can be produced without having pouch 60 appear too large for the product held within pouch 60. With folds 63, 65, pouch 60 will appear to be properly sized regardless of the size of material 66. This is provided that material 66 does not exceed the maximum volume of pouch 60.

For example, if the product that is placed within pouch 60 is switched to a fairly smaller product, the accordion-like folds 63, 65 will render pouch 60 to appear to the consumer to be about the proper size, i.e. not oversized, regardless of the product retained in pouch 60. Therefore, the production line for producing package 50 will not have to be changed to produce a smaller pouch 60.

Folds 63, 65 are formed during the formation of segment 70. As shown in FIG. 4, folds 63, 65 can be formed along portion 61 parallel to seals 62, 64. In sealing the terminal segments of portion 61 to seals 68, portion 61 is folded to align with the seals 68 creating folds 63, 65. If desired, folds 63, 65 can be formed to further define the folds by heating portions of film 52 thereby to attain a memory for the folded accordion positions. As pouch 60 is filled with product and portion 61 extends out and away from back 56, folds 63, 65 allow portion 61 to stretch out like an accordion to accommodate product. Depending upon the amount of product to be placed into pouch 60, portion 61 can comprise an extended length of material 52 designed optimally to fit the largest anticipated material 66. Thereby, pouch 60 can be designed to contain various sized materials 66 because portion 61 will bubble outward from back 56 to accommodate a desired product to be contained within pouch 60. This is advantageous as multiple product lines with various materials 66 can be made from the same production equipment without having necessarily to change production settings.

Having pouch 60 provides several advantages over standard flexible packages. With food products contained in the portion 58, having pouch 60 is beneficial, as the printed materials would not come into with it thereby avoiding any ink to food contact. An alternative advantage of pouch 60 is that other food products can be kept separate from the main contents of package 50 in portion 58. This allows separate food samples, dips, or salsas to be stored in pouch 60 and accessed separately when the consumer desires. Also, having pouch 60 extending outward from package 50 allows quick and easy access to any materials placed within pouch 60. Further, this quick and easy access does not disturb any product held within portion 58.

While the invention has been particularly shown and described with reference to a preferred embodiment, it will be understood by those skilled in the art that various changes in form and detail may be made therein without departing from the spirit and scope of the invention.

What is claimed is:

1. A method for forming a package with a pouch, comprising:

forming a sheet of film into a tube with a segment of film overlapping said tube to form said pouch;

providing a first seal and a second seal longitudinally along the pouch, wherein the distance between said first seal and said second seal along the overlapped portions of the tube is less than the length of overlap in said film; and sealing transversely both terminal ends of the tube and the pouch to form a flexible package with the pouch.

2. The method for forming the package of claim 1 further comprising placing product within the package prior to sealing the package at both terminal ends of the tube.

3. The method for forming the flexible package of claim 1 further comprising positioning a printed graphic, package, or food product within the pouch prior to forming at least one of the transverse seals at the terminal ends.

4. The method for forming the flexible package of claim 1 wherein at least one additional seal is formed between and paralleling said first seal and said second seal to form at least two pouches over the main body of the tube.

5. The method for forming the flexible package of claim 1 further comprising forming a fold in a portion of said sheet of film that forms said pouch.

6. The method for forming the flexible package of claim 5 wherein said one or more folds are formed parallel to said first seal and said second seal.

7. The method for forming the flexible package of claim 6 wherein the pouch comprises sufficient material to assume an optimal size relative to the second product contained therein.

8. A flexible package, comprising:

a main portion comprising at least a first wall and a second wall, said main portion having a first transverse seal, a second transverse seal, and a longitudinal seal, said first and said second transverse seals each extending across the width of said package, said longitudinal seal extending from said first transverse seal to said second transverse seal; and a pouch comprising a third wall and a fourth wall, wherein a region of said first wall of said main portion forms said third wall of said pouch, said pouch being bounded by said longitudinal seal, said first transverse seal and said second transverse seal and further comprising a second longitudinal seal extending between said first transverse seal and said second transverse seal;

wherein said fourth wall comprises a greater length of said flexible material than the distance between said first longitudinal seal and said second longitudinal seal along the first wall.

9. The flexible package of claim 8, wherein said main portion and said pouch are formed from a single sheet of said flexible material.

10. The flexible package of claim 8, wherein a fold is formed in said fourth wall of said pouch.

11. The flexible package of claim 8 wherein one or more additional longitudinal seals are provided to form one or more additional pouches.

12. The flexible package of claim 8 wherein a product stored in said pouch is a printed graphic, package, or food product.

13. The flexible package of claim 8 wherein said flexible material comprising said pouch contains one or more folds.

14. The flexible package of claim 13 wherein the folds are formed in said fourth wall of said pouch that are parallel to said first and said second longitudinal seals.

15. A method of forming a flexible package having a main portion and a pouch, said method comprising the steps of:

(a) forming a sheet of packaging film, having first and second sides opposite each other, around a product delivery tube, wherein said first side overlaps said second side by a given length of packaging film;

(b) forming a first longitudinal seal to seal said first side of said packaging film to an underlying portion of said packaging film;

(c) forming a second longitudinal seal to seal said second side of said packaging film to an overlying portion of said packaging film to form said pouch, wherein a distance between said first and said second longitudinal seals along the overlapped portions of the second side is less than said given length;

(d) forming a first transverse seal and a second transverse seal, each of said transverse seals being formed across the entire width of said formed packaging film, whereby said main portion and said pouch are formed sharing a common wall and at least one fold is formed in said packaging film in a wall of said pouch between said first longitudinal seal and said second longitudinal seal.

16. The method of claim 15, further comprising inserting a product into said pouch between forming said first transverse seal and said second transverse seal.

* * * * *